US011431142B2

(12) United States Patent
Kondo et al.

(10) Patent No.: US 11,431,142 B2
(45) Date of Patent: Aug. 30, 2022

(54) METHOD OF MANUFACTURING ELECTRIC WIRE WITH TERMINAL AND ELECTRIC WIRE WITH TERMINAL

(71) Applicant: Yazaki Corporation, Tokyo (JP)

(72) Inventors: Takaya Kondo, Shizuoka (JP); Junya Shinohara, Shizuoka (JP); Ryuji Sugizaki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/199,392

(22) Filed: Mar. 11, 2021

(65) Prior Publication Data

US 2021/0296839 A1 Sep. 23, 2021

(30) Foreign Application Priority Data

Mar. 18, 2020 (JP) ..... JP2020-047610

(51) Int. Cl.

| | |
|---|---|
| ***H01R 43/16*** | (2006.01) |
| ***H01R 4/02*** | (2006.01) |
| ***H01R 43/28*** | (2006.01) |
| ***H01R 43/02*** | (2006.01) |
| ***H01R 13/11*** | (2006.01) |
| ***H01B 7/00*** | (2006.01) |
| ***H01R 43/048*** | (2006.01) |
| *H01R 4/18* | (2006.01) |

(52) U.S. Cl.

CPC ..... *H01R 43/16* (2013.01); *H01B 7/0009* (2013.01); *H01R 4/021* (2013.01); *H01R 13/11* (2013.01); *H01R 43/0207* (2013.01); *H01R 43/048* (2013.01); *H01R 43/28* (2013.01); *H01R 4/185* (2013.01)

(58) Field of Classification Search

CPC .. H01R 43/16; H01R 43/0207; H01R 43/048; H01R 43/28; H01R 4/021; H01R 4/185; H01R 13/11; H01B 7/0009

USPC ..... 439/889

See application file for complete search history.

(56) References Cited

U.S. PATENT DOCUMENTS 5,240,439 A * 8/1993 Egenolf ..... H01R 13/18 439/745
5,246,390 A * 9/1993 Egenolf ..... H01R 13/18 439/839
5,338,229 A * 8/1994 Egenolf ..... H01R 13/18 439/839

(Continued)

FOREIGN PATENT DOCUMENTS

GB 2278505 A * 11/1994 ..... H01B 13/322
JP H08-250173 A 9/1996

(Continued)

*Primary Examiner* — Peter G Leigh
(74) *Attorney, Agent, or Firm* — Kenealy Vaidya LLP

(57) ABSTRACT

Provided is a method of manufacturing an electric wire with terminal formed by connecting a first core exposed portion of an electric wire to a metal terminal having a box portion that is formed by processing a single conductive board into a box shape and has an opening in which a counterpart terminal is inserted, and a spring inside the box portion. After laser-welding opposed portions where parts of the single conductive board forming the box portion are opposed to each other, applying ultrasonic vibration to a second core exposed portion of the electric wire is executed.

5 Claims, 7 Drawing Sheets

(56) References Cited

U.S. PATENT DOCUMENTS

| | | | | | |
|---|---|---|---|---|---|
| 5,536,904 | A * | 7/1996 | Kojima | H01B 13/322 | 174/76 |
| 5,593,328 | A * | 1/1997 | Okada | H01R 13/11 | 439/843 |
| 5,607,328 | A | 3/1997 | Joly | | |
| 6,226,865 | B1 * | 5/2001 | Tanikawa | H01R 9/0512 | 174/84 R |
| 6,905,376 | B2 * | 6/2005 | Chen | H01R 13/113 | 439/852 |
| 8,921,696 | B2 * | 12/2014 | Otsuka | H01R 43/0207 | 174/94 R |
| 8,944,860 | B2 * | 2/2015 | Mulot | H01R 43/16 | 439/852 |
| 9,941,601 | B2 * | 4/2018 | Kawamura | H01R 43/005 | |

FOREIGN PATENT DOCUMENTS

| | | | | |
|---|---|---|---|---|
| JP | 2004-220933 | A | 8/2004 | |
| JP | 2017-55623 | A | 3/2017 | |
| JP | 2017-84600 | A | 5/2017 | |
| JP | 2018-195497 | A | 12/2018 | |
| WO | 97/33345 | A1 | 9/1997 | |
| WO | WO-9733345 | A1 * | 9/1997 | H01R 13/113 |
| WO | WO-2010058786 | A1 * | 5/2010 | H01R 4/029 |

* cited by examiner

METHOD OF MANUFACTURING ELECTRIC WIRE WITH TERMINAL AND ELECTRIC WIRE WITH TERMINAL

CROSS-REFERENCE TO RELATED APPLICATION(S)

The present application claims priority to and incorporates by reference the entire contents of Japanese Patent Application No. 2020-047610 filed in Japan on Mar. 18, 2020.

BACKGROUND OF THE INVENTION

1. Field of the Invention

The present invention relates to a method of manufacturing an electric wire with terminal and an electric wire with terminal.

2. Description of the Related Art

In the case where an electric wire with electric wire in which a metal terminal is provided at one end of the electric wire is connected to an end portion or an intermediate portion of another electric wire, for example, as disclosed in Japanese Patent Application Laid-open No. 2017-055623, a method for stripping a coating that covers a core of the electric wire and applying ultrasonic vibration by an ultrasonic bonding machine while overlapping cores whose outer peripheral surfaces are exposed, thereby bonding the cores, has been used.

In the ultrasonic bonding of the cores, if vibration during bonding is transmitted to the metal terminal through the electric wire, a spring as a component of the metal terminal is susceptible to the influence of vibration because the rigidity of the spring is lower than those of other parts of the metal terminal. The spring is a component of a female terminal, and is integrally formed inside a box portion whose cross section is formed into a rectangular shape by a bottom plate and side walls provided upright from the bottom plate. The spring of the female terminal contacts with a tab of a male terminal for electrical connection. Thus, in the ultrasonic bonding, the influence of vibration transmitted to the metal terminal needs to be taken into consideration.

SUMMARY OF THE INVENTION

It is therefore an object of the present invention to provide a method of manufacturing an electric wire with terminal capable of suppressing vibration transmitted to a spring of a metal terminal, and an electric wire with terminal.

In order to solve the above mentioned problem and achieve the object, a method of manufacturing an electric wire with terminal according to one aspect of the present invention includes press step pressing a single conductive board to form a metal terminal including a rectangular box portion having an opening on a front side in which a counterpart terminal is inserted, a terminal connection portion having a spring inside the box portion to be brought into contact with the counterpart terminal, and an electric wire connection portion; laser welding step laser-welding opposed portions where parts of the single conductive board forming the box portion are opposed to each other when the box portion in the metal terminal is seen from a longitudinal direction; first stripping step stripping a coating portion at one end of an electric wire having a core formed by a conductor and the coating portion formed from an insulating material covering outer circumference of the core, to form a first core exposed portion; second stripping step stripping the coating portion on another end side of the one end of the electric wire, to form a second core exposed portion; connection step mechanically and electrically connecting the electric wire connection portion to the one end of the electric wire; and ultrasonic vibration applying step applying ultrasonic vibration to the second core exposed portion.

In order to achieve the object, an electric wire with terminal according to another aspect of the present invention includes an electric wire; and a metal terminal including a rectangular box portion that is a single conductive board and has an opening on a front side in which a counterpart terminal is inserted, a terminal connection portion having a spring inside the box portion to be brought into contact with the counterpart terminal, and an electric wire connection portion connected to one end of the electric wire, wherein when the box portion is seen from a longitudinal direction, the metal terminal has a laser welded portion formed at opposed portions where parts of the single conductive board forming the box portion are opposed to each other, and on another end side of the electric wire, an ultrasonic bonding portion to which a surface shape of an ultrasonic bonding tool is transferred is formed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
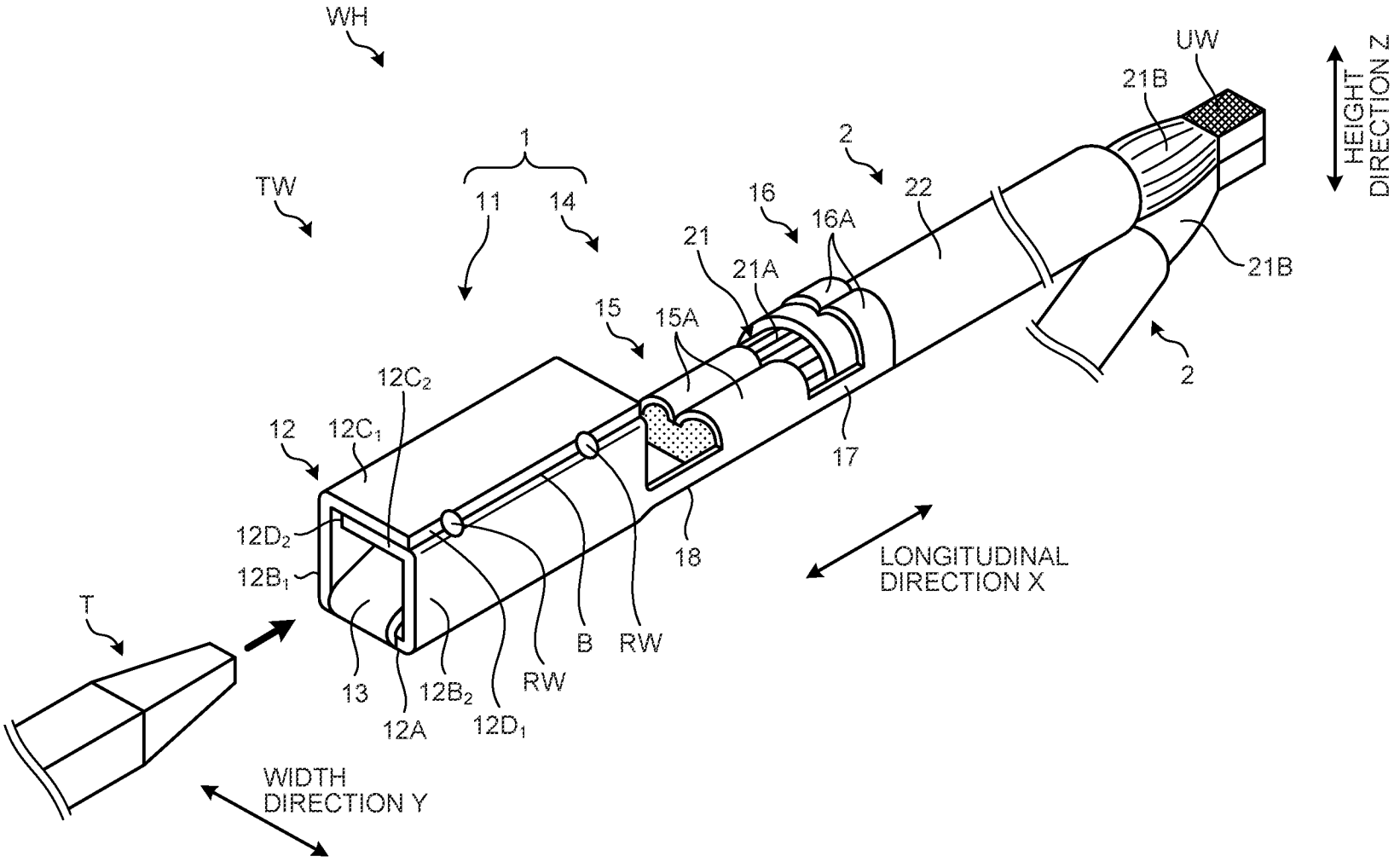
FIG. 1 is a perspective view of an electric wire with terminal according to the present embodiment.

Referring to the drawings, a method of manufacturing an electric wire with terminal and an electric wire with terminal according to embodiments of the present invention are described in detail below. Note that the present invention is not limited by the examples.

In the following description, among a first direction, a second direction, and a third direction intersecting with one another, the first direction is referred to as "longitudinal direction X", the second direction is referred to as "width direction Y", and the third direction is referred to as "height direction Z". The longitudinal direction X, the width direction Y, and the height direction Z are substantially orthogonal to one another. Typically, the longitudinal direction X corresponds to an extending direction of an electric wire provided with a metal terminal, and corresponds to an insertion direction of the metal terminal with a counterpart terminal. The width direction Y and the height direction Z correspond to intersecting directions that intersect with the longitudinal direction X. Unless otherwise specified, the directions used in the following description indicate directions in the state in which the portions are assembled together.

First Embodiment

An electric wire with terminal TW according to the present embodiment illustrated in FIG. 1 includes an electric wire 2 having conductivity and a metal terminal 1 provided to a terminal of the electric wire 2. For example, the electric wire with terminal TW according to the present embodiment is applied to a wire harness WH1 used for a vehicle.

For example, the electric wire 2 includes a linear core 21 having conductivity, and an insulating coating portion 22 covering the outer side of the core 21. The electric wire 2 is an insulating electric wire in which the core 21 is coated with the coating portion 22. The core 21 is formed by bundling a plurality of wires of conductive metal, such as copper, a copper alloy, aluminum, and an aluminum alloy. The core 21 may be a stranded core obtained by stranding a plurality of wires. The coating portion 22 is an electric wire coating that coats the outer peripheral side of the core 21. For example, the coating portion 22 is formed by extrusion molding of insulating resin material (such as PP, PVC, cross-linked PE. Material is selected as appropriate in consideration of wear resistance, chemical resistance, and heat resistance). In the electric wire 2, the coating portion 22 is stripped at least one terminal of the core 21, and the metal terminal 1 is mounted to a first core exposed portion 21A where one terminal of the core 21 is exposed from the coating portion 22. The metal terminal 1 is electrically connected to the core 21 of the electric wire 2. For example, the metal terminal 1 is held by a connector (not shown) described later. The metal terminal 1 in the present embodiment is a crimping terminal to be crimped to the terminal of the electric wire 2, but the present embodiment is not limited thereto.

Referring to FIG. 1, a wire harness WH to which the electric wire with terminal TW is applied is described. For example, the wire harness WH is configured such that a plurality of electric wires 2 used for power supply and signal communication are bundled as an assembled part (electric wire bundle) in order to connect devices mounted on a vehicle, and the electric wires 2 are connected to the devices by connectors. The wire harness WH includes at least one electric wire with terminal TW, a mated electric wire 2 (configuration is the same as electric wire 2, and the same reference number is used) to be connected to the electric wire 2 constituting the electric wire with terminal TW, and an ultrasonic bonding portion UW in which the electric wire 2 and the mated electric wire 2 are ultrasonic-bonded. The wire harness WH may further include various components such as external members as represented by a corrugated tube and a grommet, an electric connection box, and a fixture.

The wire harness WH in the present embodiment is an electric wire bundle including a plurality of (two in the present embodiment) electric wires with terminals TW. A coating portion 22 on the other side of one end of each electric wire 2 of the electric wires with terminals TW is stripped, and a second core exposed portions 21B in which the cores 21 are exposed from the coating portions 22 are mutually bonded by the ultrasonic bonding portion UW. In this case, in the wire harness WH, of the electric wires with terminals TW, the electric wire 2 of the remaining other electric wire with terminal TW corresponds to a mated electric wire 2. In each electric wire 2 in the present embodiment, at both end portions, the core 21 is exposed from the insulating coating portion 22 to constitute the first core exposed portion 21A and the second core exposed portion 21B. In each electric wire 2, the metal terminal 1 is provided at one end portion, and the metal terminal 1 is held by a housing (not shown) of a corresponding connector while the other end portions are bonded together at the ultrasonic bonding portion UW.

The ultrasonic bonding portion UW is a portion where the second core exposed portions 21B exposed from the coating portions 22 of the electric wires 2 are ultrasonic-bonded together. In the ultrasonic bonding portion UW, the bonded parts of the second core exposed portions 21B are covered and protected by a protective member (not shown) having insulating properties. In other words, the ultrasonic bonding portion UW can be regarded as constituting a branch connection portion where the electric wires 2 branch.

Figure 2:
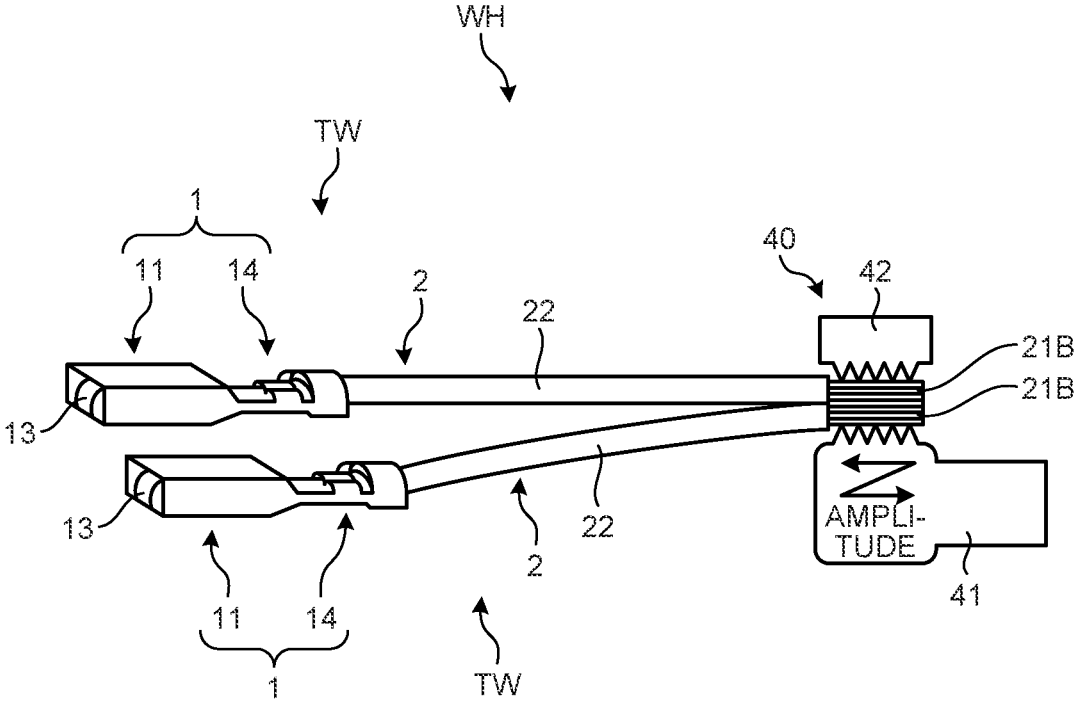
FIG. 2 is a view illustrating the outline (Example 1) of ultrasonic bonding.
Figure 3:
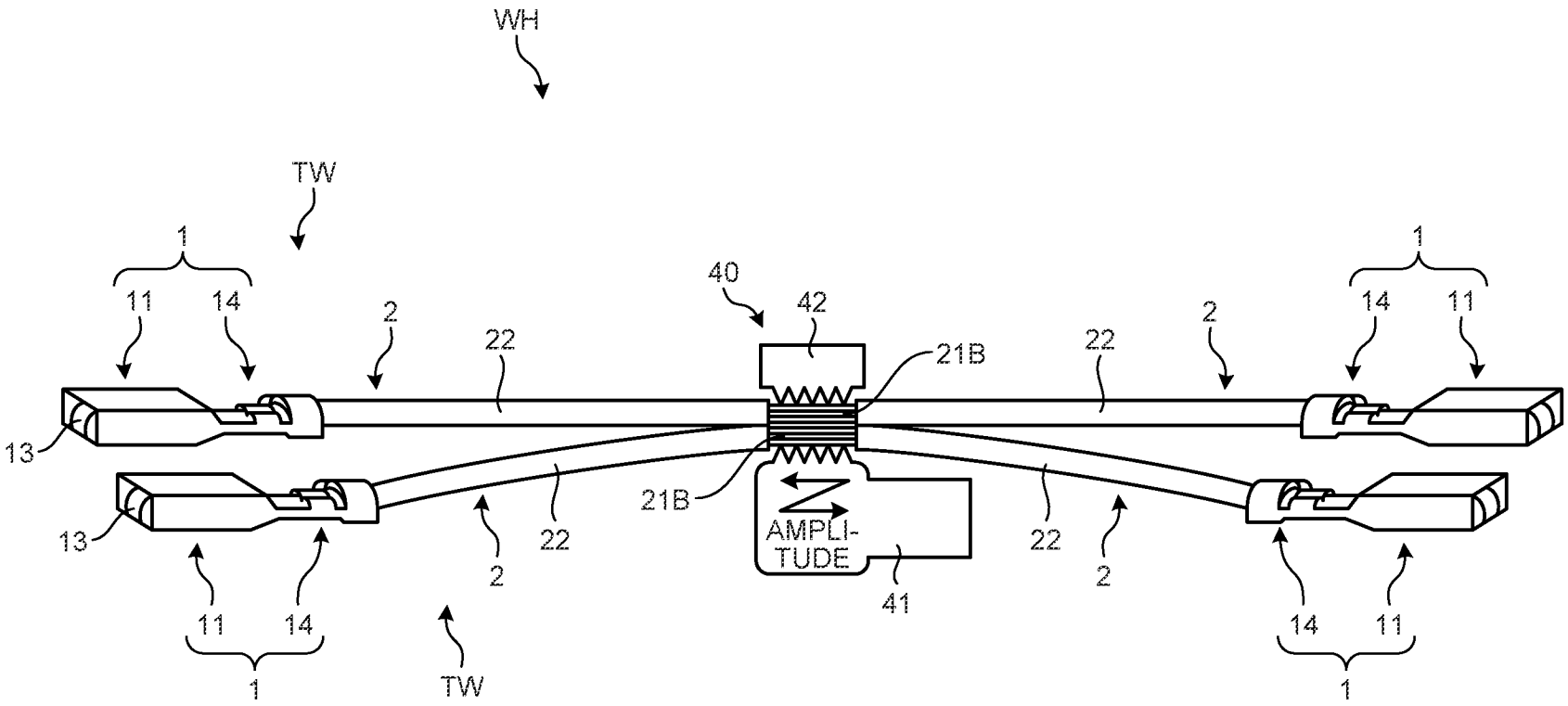
FIG. 3 is a view illustrating the outline (Example 2) of ultrasonic bonding.

As exemplified in FIG. 2 and FIG. 3, ultrasonic bonding is metal-to-metal bonding performed by applying ultrasonic vibration to connection targets from a horn 41 constituting an oscillator in an ultrasonic bonding device 40 and using the applied ultrasonic vibration. In this case, the second core exposed portions 21B of the electric wires 2 as connection targets are sandwiched by an anvil 42 as a clamping jig and the horn 41 in the state in which the exposed second core exposed portions 21B overlap with each other, and ultrasonic vibration is applied to the overlapping second core exposed portions 21B from the horn 41. As a result, in the electric wires 2, wires constituting the overlapping second core exposed portions 21B typically rub against each other by ultrasonic vibration to cause plastic deformation, and are bonded in the solid-phase state, so that the ultrasonic bonding portion UW is formed. Note that, in general, knurled indentation is formed in the surfaces of the horn 41 and the anvil 42 (surfaces that sandwich second core exposed portions 21B), and the indentation is transferred onto the bonding targets after the completion of ultrasonic bonding. Also in the electric wire with terminal in the present embodiment, when ultrasonic vibration is applied to the second core exposed portion 21B by using the horn 41 and the anvil 42, the surface shapes of the horn 41 and the anvil 42 are transferred onto a part of the second core exposed portion 21B that is sandwiched by the horn 41 and the anvil 42.

In the wire harness WH configured as described above, when ultrasonic vibration is applied to the second core exposed portion 21B in the course of forming the ultrasonic bonding portion UW, the vibration propagates through the electric wire 2 of the electric wire with terminals TW to be transmitted to the metal terminal 1. The electric wire with terminal TW in the present embodiment has the above-mentioned structure in which a laser welded portion RW formed by a laser welding step S2 described later is provided in advance to the metal terminal 1 to which vibration is transmitted as described above, thereby suppressing vibration transmitted to the metal terminal 1. Referring to FIG. 1 and FIG. 4 again, the configurations of the metal terminal 1 are described in detail below.

As illustrated in FIG. 1, the metal terminal 1 is a terminal bracket to which the electric wire 2 is electrically connected, and in and from which a counterpart terminal T having conductivity is inserted and removed. The metal terminal 1 in the present embodiment is formed into a female terminal shape, and is electrically connected to the counterpart terminal T having a male terminal shape. The counterpart terminal T is formed into a substantially rectangular columnar shape whose center axis is along the longitudinal direction X.

Specifically, the metal terminal 1 is formed from a single conductive board 10 (see FIG. 4), and includes a terminal connection portion 11 and an electric wire connection portion 14. The terminal connection portion 11 includes a box portion 12 and a spring 13 described later, and the electric wire connection portion 14 includes a core crimping portion 15 and a coating crimping portion 16 described later. The single conductive board, which forms the metal terminal 1, is made from metal having conductivity, such as copper, a copper alloy, aluminum, and an aluminum alloy. The metal terminal 1 is formed by, for example, pressing, folding, and molding a single conductive board 10 punched to have shapes corresponding to the box portion 12, the spring 13, the core crimping portion 15, and the coating crimping portion 16, so that the portions are integrated in a three-dimensional manner.

The electric wire connection portion 14 is a part to which the electric wire 2 is connected and which electrically connects the first core exposed portion 21A of the terminal of the electric wire 2 with the metal terminal 1. The electric wire connection portion 14 in the present embodiment constitutes an electric wire crimping portion to be swaged and crimped to the electric wire 2. The electric wire connection portion 14 includes a core crimping portion 15, an intermediate portion 17, and a coating crimping portion 16. The electric wire connection portion 14 is coupled side by side in the order of the core crimping portion 15, the intermediate portion 17, and the coating crimping portion 16 from the terminal connection portion 11 side to the opposite side along the longitudinal direction X.

The core crimping portion 15 is a portion that is provided on one end side of the electric wire connection portion 14 in the longitudinal direction X, in this case, on the terminal connection portion 11 side, and that is swaged and crimped to the first core exposed portion 21A of the electric wire 2. Specifically, the core crimping portion 15 is a portion to be swaged and crimped to the first core exposed portion 21A and thereby electrically connected to the first core exposed portion 21A. The core crimping portion 15 is swaged and crimped to the first core exposed portion 21A so as to wrap the outer circumference of the first core exposed portion 21A of the electric wire 2 by a base portion 18 and a core crimping pieces 15A formed to extend from the base portion 18 in a strip shape in the width direction Y. The core crimping pieces 15A are formed as a pair while extending from the base portion 18 to both sides in the width direction Y in a strip shape. In this case, the base portion 18 extends along the axial direction X to constitute a part of the core crimping portion 15, the intermediate portion 17, and the coating crimping portion 16. The bottom portion 12A of the box portion 12 is coupled to one side of the base portion 18 in the axial direction X. The terminal connection portion 11 and the electric wire connection portion 14 are electrically connected to the metal terminal 1 through the base portion 18.

The intermediate portion 17 is a portion interposed between the core crimping portion 15 and the coating crimping portion 16 to couple the core crimping portion 15 and the coating crimping portion 16 together.

The coating crimping portion 16 is a portion that is provided on the other end side of the electric wire connection portion 14 in the longitudinal direction X, in this case, on the opposite side of the terminal connection portion 11, and that is swaged and crimped to the coating portion 22 of the electric wire 2. The coating crimping portion 16 is swaged and crimped to the coating portion 22 so as to wrap the outer circumference of the coating portion 22 of the electric wire 2 by the above-mentioned base portion 18 and a coating crimping pieces 16A formed to extend from the base portion 18 in the width direction Y in a strip shape. The coating crimping pieces 16A are formed as a pair while extending from the base portion 18 to both sides in the width direction Y in a strip shape.

Note that the electric wire connection portion 14 in the present embodiment constitutes what is called "separated barrel crimping portion" in which the intermediate portion 17 is interposed between the core crimping pieces 15A of the core crimping portion 15 and the coating crimping pieces 16A of the coating crimping portion 16 such that the core crimping pieces 15A and the coating crimping pieces 16A are separated. For example, the electric wire connection portion 14 can be formed as a portion where swaging and crimping what is called "B-crimp" is performed in the state in which the pair of core crimping pieces 15A of the core crimping portion 15 do not overlap with each other. However, the shape of the electric wire connection portion 14 is not limited thereto. The electric wire connection portion 14 may constitute what is called "integrated barrel crimping portion" where the pair of core crimping pieces 15A and the pair of coating crimping pieces 16A are successive and are integrated along the longitudinal direction X in the core crimping portion 15, the intermediate portion 17, and the coating crimping portion 16. The electric wire connection portion 14 may be swaged and crimped in the state in which the pair of core crimping pieces 15A overlap with each other. The electric wire connection portion 14 is not necessarily required to be an electric wire crimping portion in the first place, and may be electrically connected to the electric wire W in other forms than crimping, such as welding and fastening.

The box portion 12 is formed into a cylindrical shape whose center axis is along the longitudinal direction X. The box portion 12 in the present embodiment is formed into a substantially rectangular cylindrical shape. The box portion 12 extends along the longitudinal direction X, and one end side in the longitudinal direction X is opened to form a terminal insertion port 11A. The electric wire connection portion 14 is coupled to the other side. In the box portion 12, an internal space portion constitutes a terminal inserting space portion 11B. The terminal inserting space portion 11B is a space portion in and from which the counterpart terminal T formed into a substantially rectangular columnar shape is inserted and removed.

More specifically, the box portion 12 is formed into an integral substantially rectangular box cylindrical shape by a bottom portion 12A, a first side wall portion 12$B_1$, a second side wall portion 12$B_2$, a first ceiling portion 12$C_1$, and a second ceiling portion 12$C_2$.

The bottom portion 12A is formed into a substantially rectangular plate shape whose plate thickness direction is along the height direction Z, and extends along the longitudinal direction X. An end portion of the bottom portion 12A in the longitudinal direction X on the other side of the terminal insertion port 11A is coupled to the base portion 18 of the electric wire connection portion 14.

The first side wall portion 12$B_1$ and the second side wall portion 12$B_2$ are portions extending along the height direction Z from both ends of the bottom portion 12A in the width direction Y. The first side wall portion 12$B_1$ and the second side wall portion $12B_2$ are formed into a substantially rectangular plate shape whose plate thickness direction is along the width direction Y, and extend along the longitudinal direction X. The first side wall portion $12B_1$ and the second side wall portion $12B_2$ are opposed across the terminal inserting space portion 11B along the width direction Y with spaces. The first ceiling portion $12C_1$ and the second ceiling portion $12C_2$ are portions extending from the first side wall portion $12B_1$ and the second side wall portion $12B_2$ along the width direction Y, respectively. Similarly to the above-mentioned bottom portion 12A, the first ceiling portion $12C_1$ and the second ceiling portion $12C_2$ are formed into a substantially rectangular plate shape whose plate thickness direction is along the height direction Z, and extend along the longitudinal direction X. The first ceiling portion $12C_1$, the second ceiling portion $12C_2$, and the above-mentioned bottom portion 12A are opposed across the terminal inserting space portion 11B along the height direction Z with spaces. In this case, of the first ceiling portion $12C_1$ and the second ceiling portion $12C_2$, the second ceiling portion $12C_2$ is located on the inner side (terminal inserting space portion 11B side), and the first ceiling portion $12C_1$ is located on the outer side (opposite side of terminal inserting space portion 11B), and the first ceiling portion $12C_1$ and the second ceiling portion $12C_2$ overlap along the height direction Z.

The terminal inserting space portion 11B is sectioned by the bottom portion 12A, the first side wall portion $12B_1$, the second side wall portion $12B_2$, the first ceiling portion $12C_1$, and the second ceiling portion $12C_2$ formed as described above. Specifically, the terminal inserting space portion 11B are sectioned in the height direction Z by the bottom portion 12A, the first ceiling portion $12C_1$, and the second ceiling portion $12C_2$, and sectioned in the width direction Y by the first side wall portion $12B_1$ and the second side wall portion $12B_2$. In this manner, the terminal inserting space portion 11B is formed inside the box portion 12 while extending along the longitudinal direction X. In the box portion 12, the terminal insertion port 11A for the terminal inserting space portion 11B is formed at one end portion of each of the bottom portion 12A, the first side wall portion $12B_1$, the second side wall portion $12B_2$, and the second ceiling portion $12C_2$ in the longitudinal direction X (end portion on opposite side of electric wire connection portion 14). In the box portion 12, the counterpart terminal T is inserted in the internal terminal inserting space portion 11B along the longitudinal direction X through the terminal insertion port 11A formed at one end portion in the longitudinal direction X.

The spring 13 is a portion located inside the terminal inserting space portion 11B and supported by the box portion 12 in a cantilever manner so as to be elastically deformable, thereby forming a contact with the counterpart terminal T. The spring 13 is formed into a substantially rectangular plate shape whose plate thickness direction is along the height direction Z, and extends along the longitudinal direction X. The spring 13 is located to be opposed to the bottom portion 12A on one side in the height direction Z, and opposed to the first ceiling portion $12C_1$ and the second ceiling portion $12C_2$ on the other side. An end portion of the spring 13 in the longitudinal direction X on the terminal insertion port 11A side is coupled to the bottom portion 12A and supported. Specifically, a base end portion of the spring 13, which is an end portion in the longitudinal direction X on the terminal insertion port 11A side, is coupled to the bottom portion 12A and supported, and a distal end portion thereof, which is an end portion in the longitudinal direction X on the opposite side of the terminal insertion port 11A, is a free end. In this case, an end portion of the spring 13 in the longitudinal direction X on the terminal insertion port 11A side is folded continuously from the bottom portion 12A such that a base end portion supported by the bottom portion 12A is formed. In this manner, the spring 13 in the present embodiment is supported by the bottom portion 12A in a cantilever manner so as to be elastically deformable in the height direction Z. Note that an intermediate portion of the spring 13 in the longitudinal direction X is bent so as to protrude toward the first and second ceiling portions $12C_1$ and $12C_2$, so that a contact portion 13A (see FIG. 8) is formed. The contact portion 13A is a main portion to be brought into contact with the counterpart terminal T inserted in the terminal inserting space portion 11B and form a contact with the counterpart terminal T for conduction.

In the metal terminal 1 configured as described above, the counterpart terminal T is inserted in the terminal inserting space portion 11B through the terminal insertion port 11A along the longitudinal direction X. In this case, in the metal terminal 1, the counterpart terminal T is inserted in the terminal inserting space portion 11B while warping the spring 13 to the bottom portion 12A side. In the metal terminal 1, the spring 13 contacts with the counterpart terminal T through the contact portion 13A, and is pressed to the counterpart terminal T due to its own elastic restoring force, thereby forming a contact with the counterpart terminal T. As a result, the metal terminal 1 is electrically connected to the counterpart terminal T through a contact portion 30A, and the electric wire 2 and the counterpart terminal T can be electrically connected.

In the metal terminal 1 according to the present embodiment configured as described above, the box portion 12 further has the laser welded portion RW, and hence implements a configuration having appropriate conduction performance. The laser welded portion RW is a portion formed on the box portion 12, for mainly regulating relative displacement between the first side wall portion $12B_1$ and the second side wall portion $12B_2$.

Specifically, the laser welded portion RW is formed at opposed portions where parts of the single conductive board 10 forming the box portion 12 are opposed. The opposed portions according to the present embodiment are portions where the first ceiling portion $12C_1$ and the second ceiling portion $12C_2$ are opposed in the height direction Z, and include a boundary B that is a surface where the first ceiling portion $12C_1$ and the second ceiling portion $12C_2$ are opposed to each other or an edge of parts where the first ceiling portion $12C_1$ and the second ceiling portion $12C_2$ overlap. As illustrated in FIG. 1, in the present embodiment, the laser welded portion RW is formed on the boundary B at the opposed portions. It is preferred to form the laser welded portion RW on the boundary B because whether laser welding is appropriately performed can be more easily evaluated in the observation of the metal terminal 1 than when the laser welded portion RW is formed on a location other than the boundary B at the opposed portions (in the present embodiment, surface where ceiling portions $12C_1$ and $12C_2$ overlap).

Method of Manufacturing Electric Wire with Terminal

Figure 6:
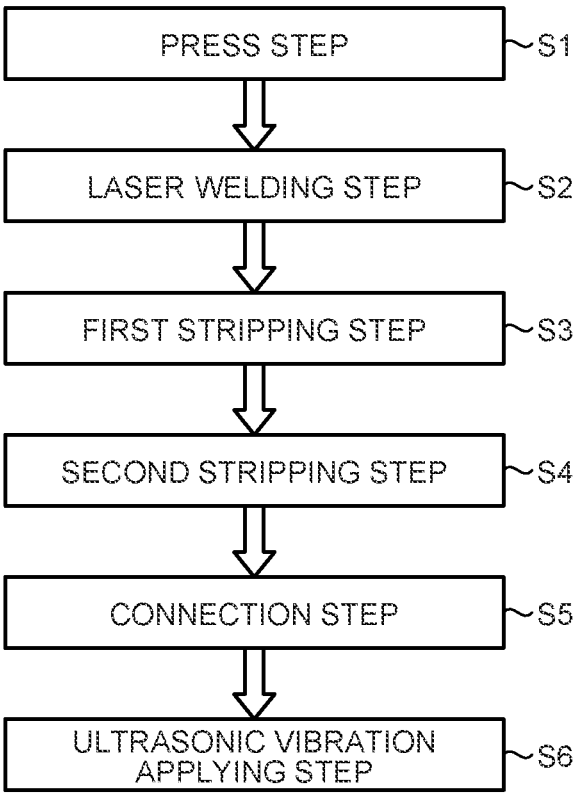
FIG. 6 is a flowchart illustrating a method of manufacturing an electric wire with terminal.

A method of manufacturing the electric wire with terminal TW in the present embodiment is described. As illustrated in FIG. 6, the method of manufacturing the electric wire with terminal TW includes a press step S1, a laser welding step S2, a first stripping step S3, a second stripping step S4, a connection step S5, and an ultrasonic vibration applying step S6. The press step S1 is a step for processing a single conductive board 10 to form a terminal connection portion 11 and an electric wire connection portion 14. The laser welding step S2 is a step for applying laser R to a box portion 12 in the terminal connection portion 11 to weld opposed parts by laser. The first stripping step S3 is a step for removing a coating portion 22 at one end of an electric wire 2 and exposing the outer peripheral surface of a core 21 to form a first core exposed portion 21A. The second stripping step S4 is a step for removing a coating portion 22 on the other end side of one end of the electric wire 2 and exposing the outer peripheral surface of the core 21 to form a second core exposed portion 21B. The connection step S5 is a step for connecting the electric wire 2 to a metal terminal 1. The ultrasonic vibration applying step S6 is a step for applying ultrasonic vibration to the second core exposed portion 21B, and in the present embodiment, a step for applying ultrasonic vibration to second core exposed portions 21B of a plurality of electric wires 2 to bond the second core exposed portions 21B and the electric wires 2 together.

Press Step S1

Figure 4:
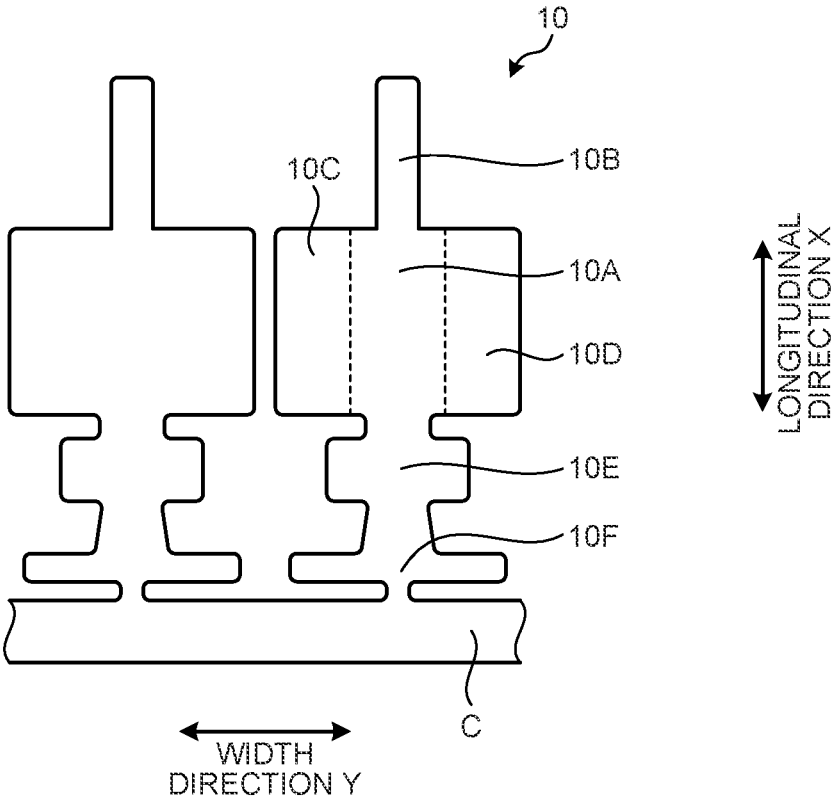
FIG. 4 is a view illustrating a metal terminal before a press step.

At the press step S1, a press device (not shown) is used to mold a single conductive board 10 and form the terminal connection portion 11 and the electric wire connection portion 14. As illustrated in FIG. 4, in the single conductive board 10, a front protruding portion 10B constituting the spring 13 is continuously provided at a front end of a substrate 10A extending in the longitudinal direction X, rectangular plate portions 10C and 10D for constituting the box portion 12 with the substrate 10A as the bottom portion 12A are continuously provided on both sides of the substrate 10A in the width direction Y, and horizontal protruding portions 10E and 10F for constituting the core crimping portion 15 and the coating crimping portion 16 are continuously provided on the rear side of the substrate 10A. The rear end of the horizontal protruding portion 10F is connected to a carrier C extending in the width direction Y, and a plurality of single conductive boards 10 are consecutively manufactured.

Figure 5:
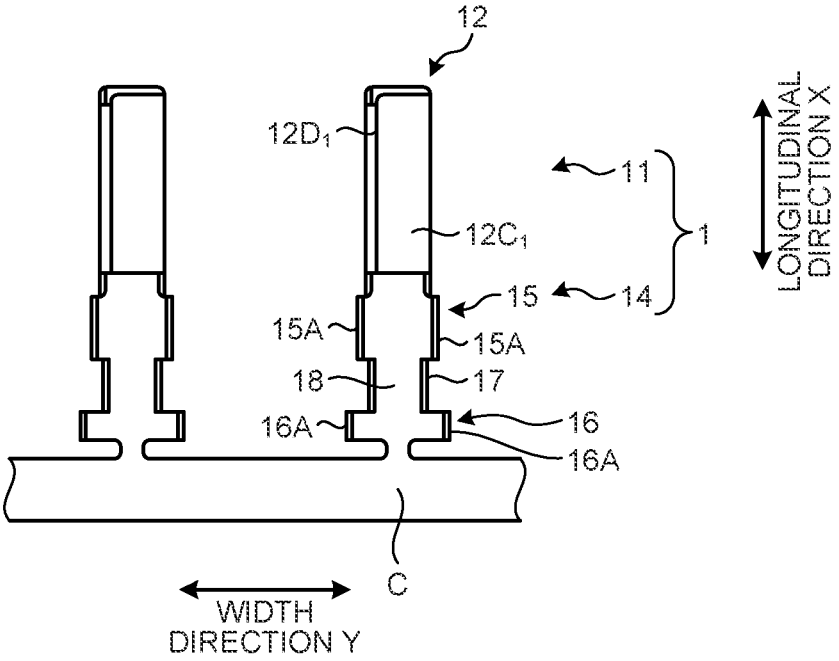
FIG. 5 is a view illustrating the metal terminal after the press step.
Figure 7:
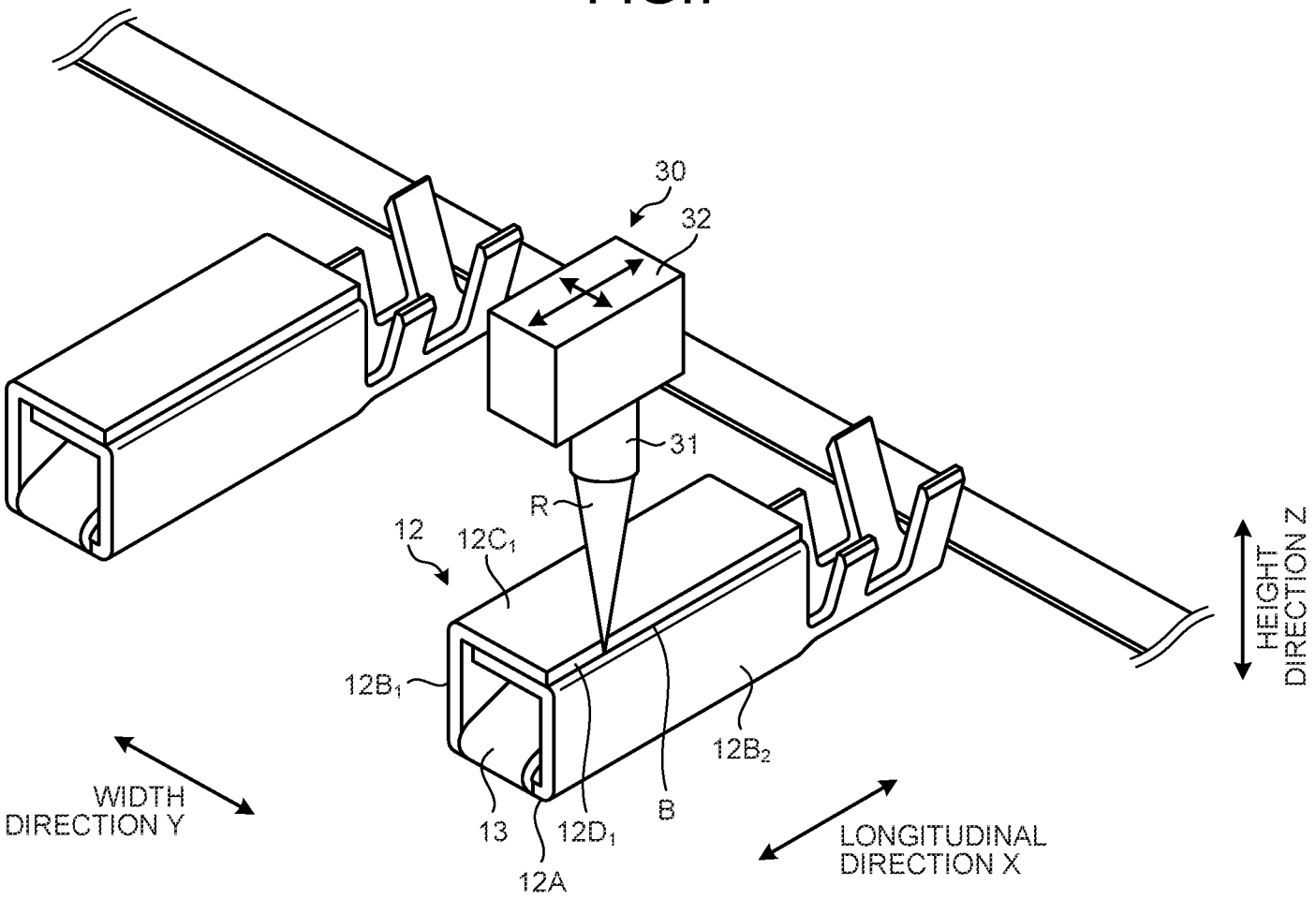
FIG. 7 is a view illustrating a laser welding step.

At the press step S1, as illustrated in FIG. 5 and FIG. 7, the front protruding portion 10B of the single conductive board 10 is folded backward in the longitudinal direction X to form the spring 13, and the rectangular plate portions 10B and 10C are folded in a rectangular shape with the substrate 10A as the bottom portion 12A so as to house the spring 13 therein, thereby forming the box portion 12. In this case, the rectangular plate portion 10B is folded into a substantially L-shape to constitute the first side wall portion $12B_1$ and the first ceiling portion $12C_1$, and the rectangular end portion 10C is folded into a substantially L-shape horizontally symmetric with the rectangular plate portion 10B to constitute the second side wall portion $12B_2$ and the second ceiling portion $12C_2$. In the present embodiment, of the first ceiling portion $12C_1$ and the second ceiling portion $12C_2$, the second ceiling portion $12C_2$ is located on the inner side (terminal inserting space portion 11B side), and the first ceiling portion $12C_1$ is located on the outer side (opposite side of terminal inserting space portion 11B). The first ceiling portion $12C_1$ and the second ceiling portion $12C_2$ overlap in the height direction Z.

The horizontal protruding portions 10E and 10F are folded to the height direction Z side to have a substantially U-shape, thereby constituting the core crimping portion 15 and the coating crimping portion 16, respectively.

Laser Welding Step S2

At the laser welding step S2, as illustrated in FIG. 7, a laser welder 30 is used to apply laser R to the box portion 12 of the metal terminal 1 and weld opposed parts by laser. The laser welder 30 includes a laser head 31 for applying laser R supplied from a laser light source and a movement mechanism 32 for moving the laser head 31. For example, the movement mechanism 32 is configured by a stage capable of freely moving in the longitudinal direction X, and the laser head 31 moves so as to be disposed immediately above the opposed portions of the box portion 12 (boundary B in FIG. 7). In the state in which the laser head 31 is disposed immediately above the opposed portions, laser R is applied to the opposed portions to form the laser welded portion RW. In the present embodiment, the box portion 12 has the opposed portions extending in the longitudinal direction X, and two laser welding portions RW are formed in the form of spots on the boundary B, which is the edge of the opposing portions (see FIG. 1). The effect of forming the laser welded portion RW is described later, but by forming two or more laser welded portions RW at the opposed portions in the longitudinal direction X, when ultrasonic vibration is transmitted to the metal terminal 1 through the electric wire 2 in the ultrasonic vibration applying step S6, the box portion 12 can be suppressed from vibrating in the direction of twisting against the longitudinal direction X. The effect of the ultrasonic vibration on the spring 13 is further suppressed. The configuration of the movement mechanism 32 is not limited thereto. For example, the position of the laser head 31 may be freely adjusted by a robot arm.

First Stripping Step S3

At the first stripping step S3, a stripping device (not shown) is used to strip the coating portion 22 at one end of the electric wire 2 and expose the outer peripheral surface of the core 21, thereby forming the first core exposed portion 21A. As the stripping device, for example, a publicly known stripe device is applied.

Second Stripping Step S4

At the second stripping step S4, a stripping device (not shown) is used to strip the coating portion 22 on the other end side of one end of the electric wire 2 and expose the outer peripheral surface of the core 21, thereby forming the second core exposed portion 21B. The second core exposed portion 21B only needs to be on the other end side of one end of the electric wire 2. FIG. 2 illustrates an example in which the second core exposed portion 21B is formed at the other end of the electric wire 2, and FIG. 3 illustrates an example in which the second core exposed portion 21B is formed near the middle between one end and the other end of the electric wire 2. As the stripping device, for example, a publicly known stripe device is applied. The same device as that at the first stripping step S3 may be used, and a different device may be used.

Connection Step S5

The connection step S5 is executed by a terminal crimping device (not shown). The terminal crimping device is a publicly known crimping device including an anvil for placing a metal terminal 1 before crimping thereon, and a crimper configured to lower with respect to the anvil to swage the core crimping portion 15 and the coating crimping portion 16 to the electric wire 2. The first core exposed portion 21A of the electric wire 2 is placed on the core crimping portion 15 of the metal terminal 1, and the coating portion 22 is placed on the coating crimping portion 16. Grooves along the outer circumference of the electric wire 2 are formed in the bottom surface of the crimper, and when the crimper is lowered toward the anvil, the core crimping pieces 15A and the coating crimping pieces 16A of the metal terminal 1 slidingly contact with the inner surfaces of the grooves of the crimper, and the core crimping pieces 15A and the coating crimping pieces 16A are deformed so as to wrap the outer circumference of the electric wire 2. As a result, as illustrated in FIG. 1, the core crimping pieces 15A and the coating crimping pieces 16A are crimped to the first core exposed portion 21A and the coating portion 22, respectively.

Ultrasonic Vibration Applying Step S6

The ultrasonic vibration applying step S6 is executed by the ultrasonic bonding device 40. As illustrated in FIGS. 2 and 3, the ultrasonic bonding device 40 includes an anvil 42 for placing a plurality of electric wires 2 thereon, and a horn 41 for applying ultrasonic vibration to the electric wires 2. Each of the second core exposed portions 21B of the electric wires 2 is placed on the anvil 42. The horn 41 moves relatively to the anvil 42 so as to sandwich a plurality of second core exposed portions 21B. The horn 41 applies ultrasonic vibration to the second core exposed portions 21B sandwiched by the horn 41 and the anvil 42. Due to ultrasonic vibration, oxide films and dirt formed on the outer circumference of wires constituting the second core exposed portion 21B are mechanically scattered such that newly formed surfaces are brought into intimate contact with each other, so that the wires are bonded in the solid phase state. Owing to this principle, the second core exposed portions 21B are bonded together to form the ultrasonic bonding portion UW. The ultrasonic vibration applying step S6 in the present embodiment is a step for bundling the electric wires 2 and applying ultrasonic vibration thereto to bond the electric wires 2, but the present embodiment is not limited thereto. For example, the ultrasonic vibration applying step S6 includes, as preprocessing for crimping the metal terminal 1, a step for applying ultrasonic vibration to the second core exposed portion 21B of a single electric wire 2 in order to remove an oxide coating film formed on the outer circumference of the wire constituting the second core exposed portion 21B.

In general, knurled indentation is formed in the surfaces of the horn 41 and the anvil 42 (surfaces sandwiching second core exposed portion 21B), and the indentation is transferred onto bonding targets after the completion of ultrasonic bonding. Also in the electric wire with terminal in the present embodiment, when ultrasonic vibration is applied to the second core exposed portion 21B by using the horn 41 and the anvil 42, the surface shapes of the horn 41 and the anvil 42 are transferred onto a part of the second core exposed portion 21B that is sandwiched by the horn 41 and the anvil 42.

The ultrasonic vibration applying step S6 is performed after at least the laser welding step S2 and the connection step S5. In this manner, when ultrasonic vibration is applied to a second core exposed portion 22B, the ultrasonic vibration propagates to the metal terminal 1 connected to the first core exposed portion 21A through the electric wire 2, but the laser welded portion RW is formed on the box portion 12 in the metal terminal 1, and hence the effect of the ultrasonic vibration on the spring 13 can be suppressed. From the next paragraph, the effect of ultrasonic vibration on the metal terminal 1 and the functions and effects obtained by forming the laser welded portion R are described in detail.

The spring 13 extending from one end of the metal terminal 1 in a cantilever manner is apt to greatly swing when ultrasonic vibration is transmitted to the metal terminal 1, and fatigue (stress) is concentrated near the root. Furthermore, when ultrasonic vibration is applied for a long time, the influence on the spring 13 increase, and the spring 13 may be damaged. The inventors of the present invention observed the behavior of the spring 13 in the metal terminal 1 in the course of applying ultrasonic vibration to the second core exposed portion 21B. From the observation, the inventors of the present invention found that when ultrasonic vibration is transmitted to the box portion 12 in the metal terminal 1, the bottom portion 12A connected to the spring 13 and the first side wall portion $\mathbf{12}B_1$ and the second side wall portion $\mathbf{12}B_2$ provided upright from the bottom portion 12A greatly swing relative to each other. It is considered that the relative motion of the side wall portions $\mathbf{12}B_1$ and $\mathbf{12}B_2$ with respect to the bottom portion 12A is transmitted to the spring 13 formed inside the box portion 12, and hence the amplitude of the spring more increases to affect the concentration of fatigue (stress). The relative motion of the side wall portions $\mathbf{12}B_1$ and $\mathbf{12}B_2$ with respect to the bottom portion 12A is caused because the box portion 12 is formed by processing a single conductive board 10 into a box shape and is not a single closed box, that is, a rigid body. In particular, in the metal terminal 1 according to the present embodiment, the side wall portions $\mathbf{12}B_1$ and $\mathbf{12}B_2$ are provided upright from both ends of the bottom portion 12A in the width direction Y, and hence it is considered that, at the ultrasonic vibration applying step S6, a plurality of wall surfaces greatly move with respect to the bottom portion 12A, and load on the spring increases. Based on the above-mentioned consideration, the inventors of the present invention conceived of forming the laser welded portion RW on the box portion 12 in order to suppress the relative motion caused in the box portion 12.

Figure 8:
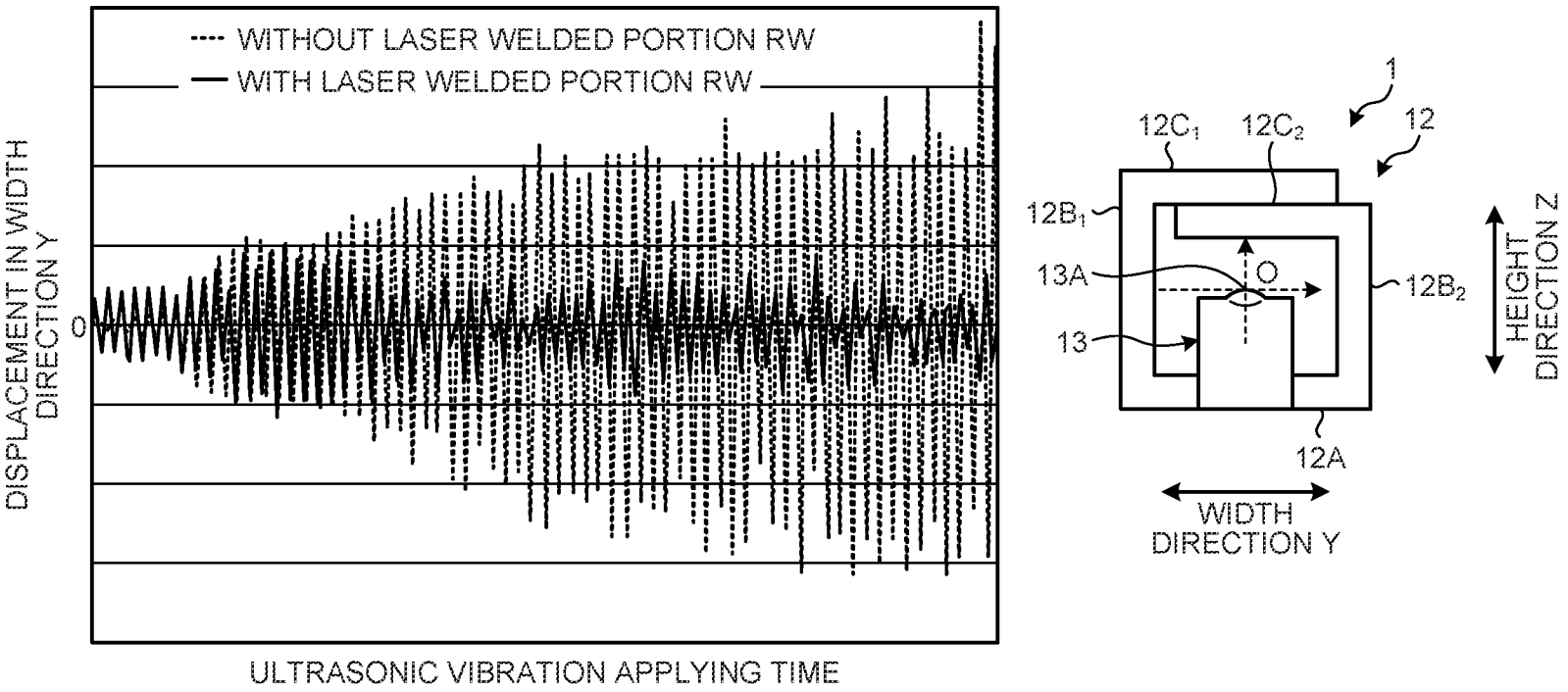
FIG. 8 is a diagram illustrating analysis results of displacement of a contact portion.

To confirm the effect obtained by forming the laser welded portion RW on the box portion 12, the behavior of the spring 13 at the ultrasonic vibration applying step S6 was photographed by a high-speed camera (not shown), and image analysis was performed. As illustrated in FIG. 8, the contact portion 13A of the spring 13 was focused, and displacement of the contact portion 13A in the width direction Y caused by the swinging of the spring 13 during the application of ultrasonic vibration to the second core exposed portion 21B was calculated. The vertical axis indicates the displacement of the contact portion 13A in the width direction Y, and the horizontal axis indicates time during which ultrasonic vibration is applied. In the present observation, a metal terminal 1 (see FIG. 1) in which the laser welded portion RW was formed on the boundary B on the box portion 12 and a metal terminal 1 in which the laser welded portion RW was not formed on the boundary B on the box portion 12 were prepared, and displacements of the contact portions 13A in the Y direction were compared. By observing the displacements of the contact portions 13A in the two metal terminals 1, it is understood that both the contact portions 13A displace horizontally in a wave pattern with respect to the origin O in the width direction Y due to the influence of ultrasonic vibration applied to the second core exposed portion 21B.

It is also understood that the magnitude of the displacement of the metal terminal 1 in which the laser welded portion RW is formed in the width direction Y is smaller than the magnitude of the displacement of the metal terminal 1 in which the laser welded portion RW is not formed in the width direction Y. It is considered that the difference in magnitude of the displacements occurs because in the metal terminal 1 in which the laser welded portion RW is not formed, the bottom portion 12A connected to the spring 13 and the first side wall portion $\mathbf{12}B_1$ and the second side wall portion $\mathbf{12}B_2$ provided upright from the bottom portion 12A greatly swing with respect to each other, and the swinging is transmitted to the spring 13 to increase the amplitude of the spring 13. On the other hand, in the metal terminal 1 in which the laser welded portion RW is formed, the box portion 12 has a closed box shape due to the laser welded portion RW, and hence the relative motion caused between the bottom portion 12A and the first side wall portion $\mathbf{12}B_1$ and the second side wall portion $\mathbf{12}B_2$ is suppressed. Thus, the influence that the amplitude of the spring 13 increases by the above-mentioned relative motion is suppressed to reduce the load on the spring 13.

While the embodiments of the present invention have been described above, the embodiments are illustrative and are not intended to limit the scope of the invention. The embodiments can be carried out in other various forms, and can be variously omitted, replaced, and changed within the range not departing from the gist of the invention. The embodiments and modifications thereof are included in the scope and gist of the invention and similarly included in the invention as recited in the claims and its equivalences.

The laser welding step S2 in the present embodiment is the second step in FIG. 6, but the present embodiment is not limited thereto. The laser welding step S2 only needs to be after at least the press step S1 and before the ultrasonic vibration applying step S6.

In the box portion 12 in the metal terminal 1 in the present embodiment, the spring 13 is connected to the front end of the bottom portion 12A, the side wall portions $\mathbf{12}B_1$ and $\mathbf{12}B_2$ are provided upright from both ends of the bottom portion 12A in the width direction Y, and the ceiling portions $\mathbf{12}C_1$ and $\mathbf{12}C_2$ extending from the side wall portions $\mathbf{12}B_1$ and $\mathbf{12}B_2$ overlap with each other, thereby forming a box shape, but the present embodiment is not limited thereto. For example, the ceiling portions $\mathbf{12}C_1$ and $\mathbf{12}C_2$ are not necessarily required to overlap with each other, and a first end surface $\mathbf{12}D_1$ and a second end surface $\mathbf{12}D_2$ of the ceiling portions $\mathbf{12}C_1$ and $\mathbf{12}C_2$ may be opposed to each other. The first side wall portion $\mathbf{12}B_1$ may be provided upright from one end of the bottom portion 12A connected to the spring 13 in the width direction Y, and the boundary B may be formed between the bottom portion 12A and the second side wall portion $\mathbf{12}B_2$ (in this case, upper ends of side wall portions $\mathbf{12}B_1$ and $\mathbf{12}B_2$ are connected by single ceiling portion). In other words, the box portion 12 only needs to have a boundary B while being obtained by processing a single conductive board 10 into a box shape, in which the spring 13 to be brought into contact with the counterpart terminal T is provided on any one of wall surfaces constituting the box portion 12.

In the metal terminal 1 in the present embodiment, the opposed portions of the box portion 12 extend in the longitudinal direction X, and two laser welded portions RW are formed on the boundary B as an edge of the opposed portions in a spot pattern, but the present embodiment is not limited to this configuration. For example, the following configurations may be employed: 1) the laser welded portion RW is formed at a location other than the boundary B on the opposed portions (in the present embodiment, surfaces where ceiling portions $\mathbf{12}C_1$ and $\mathbf{12}C_2$ overlap); 2) the laser welded portions RW extend linearly rather than in a spot pattern; 3) the laser welded portion RW is formed on the boundary B at the front end of the metal terminal 1 in the longitudinal direction X; and 4) the laser welded portion RW is formed at only one location or three or more locations in the longitudinal direction X.

The box portion 12 in the metal terminal 1 in the present embodiment has a configuration in which the ceiling portions $\mathbf{12}C_1$ and $\mathbf{12}C_2$ simply overlap with each other, but the present embodiment is not limited thereto. For example, a configuration in which a pair of the ceiling portions $\mathbf{12}C_1$ and $\mathbf{12}C_2$ are engaged with each other may be added, and the laser welded portion RW may be formed on the opposed portions.

In the method of manufacturing an electric wire with terminal and the electric wire with terminal according to the present embodiment, laser is applied to opposed parts where single conductive boards each forming a box portion of a metal terminal to weld the opposed parts, and hence even when ultrasonic vibration is transmitted to the metal terminal, relative motion between a bottom portion from which a spring extends in the box portion and wall portions provided upright from the bottom portion is suppressed. Accordingly, vibration transmitted to the spring is suppressed, and the influence of ultrasonic vibration on the spring is suppressed. Because the influence of vibration on the spring is suppressed, an effect in that constraints on conditions of ultrasonic bonding are reduced to improve the degree of freedom in design is exhibited.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of manufacturing an electric wire with terminal, the method comprising:

press step pressing a single conductive board to form a metal terminal including a rectangular box portion having an opening on a front side in which a counterpart terminal is inserted, a terminal connection portion having a spring inside the box portion to be brought into contact with the counterpart terminal, and an electric wire connection portion;

laser welding step laser-welding opposed portions where parts of the single conductive board forming the box portion are opposed to each other when the box portion in the metal terminal is seen from a longitudinal direction;

first stripping step stripping a coating portion at one end of an electric wire having a core formed by a conductor and the coating portion formed from an insulating material covering outer circumference of the core, to form a first core exposed portion;

second stripping step stripping the coating portion on another end side of the one end of the electric wire, to form a second core exposed portion;

connection step mechanically and electrically connecting the electric wire connection portion to the one end of the electric wire; and ultrasonic vibration applying step applying ultrasonic vibration to the second core exposed portion, wherein the ultrasonic vibration applying step is performed after the laser welding step.

2. The method of manufacturing an electric wire with terminal according to claim 1, wherein the laser welding step includes applying laser to a boundary in which parts of the single conductive board overlap with each other when seen from an outer peripheral side of the box portion to laser-weld the opposed portions.

3. The method of manufacturing an electric wire with terminal according to claim 1, wherein the laser welding step includes applying laser to the opposed portions formed to extend in the longitudinal direction with spaces at least two locations in the longitudinal direction to laser-weld the opposed portions.

4. The method of manufacturing an electric wire with terminal according to claim 2, wherein the laser welding step includes applying laser to the opposed portions formed to extend in the longitudinal direction with spaces at least two locations in the longitudinal direction to laser-weld the opposed portions.

5. An electric wire with terminal, comprising:

an electric wire; and a metal terminal including a rectangular box portion that is a single conductive board and has an opening on a front side in which a counterpart terminal is inserted, a terminal connection portion having a spring inside the box portion to be brought into contact with the counterpart terminal, and an electric wire connection portion connected to one end of the electric wire, wherein when the box portion is seen from a longitudinal direction, the metal terminal has a laser welded portion formed at a boundary that is a portion where a first ceiling portion and a second ceiling portion of the single conductive board forming the box portion are opposed in a height direction and is an edge of parts where the first ceiling portion and the second ceiling portion overlap, and on another end side of the electric wire, an ultrasonic bonding portion to which a surface shape of an ultrasonic bonding tool is transferred is formed.

* * * * *